US011452408B2

(12) United States Patent
Gano

(10) Patent No.: US 11,452,408 B2
(45) Date of Patent: Sep. 27, 2022

(54) TISSUE DISPENSER

(71) Applicant: Thomas Gano, Carmel Valley, CA (US)

(72) Inventor: Thomas Gano, Carmel Valley, CA (US)

( * ) Notice: Subject to any disclaimer, the term of this patent is extended or adjusted under 35 U.S.C. 154(b) by 0 days.

(21) Appl. No.: 17/009,636

(22) Filed: Sep. 1, 2020

(65) Prior Publication Data

US 2022/0061600 A1 Mar. 3, 2022

(51) Int. Cl.

*A47K 10/46* (2006.01)
*A47K 10/42* (2006.01)
*A47K 10/32* (2006.01)

(52) U.S. Cl.

CPC ..... *A47K 10/46* (2013.01); *A47K 10/421* (2013.01); *A47K 2010/3266* (2013.01)

(58) Field of Classification Search

CPC ..... A61F 13/5515; B65F 1/00; B65F 1/1607; B65F 1/02; B65F 1/1646; B65F 2001/1676; B65F 2240/164; A47K 10/46; A47K 10/421; A47K 2010/3266

USPC ..... 221/35, 102

See application file for complete search history.

(56) References Cited

U.S. PATENT DOCUMENTS 1,988,939 A * 1/1935 Craig ..... B65D 83/0888 221/34
2,832,498 A * 4/1958 Parsons ..... B60N 3/08 220/481
2,841,275 A * 7/1958 Schwimmer ..... B65D 83/0888 206/233
2,915,218 A * 12/1959 Rosenman ..... B65D 5/5011 221/102
3,095,087 A * 6/1963 Yates ..... A47K 10/421 206/449
3,221,928 A * 12/1965 Horn ..... A47K 10/421 221/34
3,245,580 A * 4/1966 Campanella ..... B65D 83/0805 221/34
3,270,938 A * 9/1966 Rhinegold ..... B65D 83/0888 229/101
3,331,498 A * 7/1967 Davies ..... A47K 10/24 206/494
3,372,837 A * 3/1968 Neumann ..... B65D 5/38 221/34
4,513,862 A * 4/1985 Mallow ..... B65D 5/42 206/213.1
4,879,442 A * 11/1989 Giovine ..... B65D 83/0888 206/233
4,919,302 A * 4/1990 McPherson ..... A47K 10/28 221/34
4,961,522 A * 10/1990 Weber ..... A45C 3/00 190/119
5,054,612 A * 10/1991 Meyer, Jr. ..... B65D 83/0888 206/233
5,129,545 A * 7/1992 Parks ..... B65D 83/0888 221/102
5,638,957 A * 6/1997 Brasier ..... A61F 15/001 206/581

(Continued)

*Primary Examiner* — Rakesh Kumar
(74) *Attorney, Agent, or Firm* — JRG Attorneys at Law

(57) ABSTRACT

Light-weight containers for holding, transporting and dispensing light-weight tissues and other wipes which provide for dispensing unused tissues from one compartment and receiving used tissues into the second compartment.

10 Claims, 4 Drawing Sheets

(56) References Cited

U.S. PATENT DOCUMENTS 6,152,079 A * 11/2000 Chandler ..... B65F 1/141 119/161
6,349,849 B1 * 2/2002 Pehr ..... A47K 10/421 221/33
6,371,296 B1 * 4/2002 Rumbough ..... A47K 10/185 206/233
6,439,386 B1 * 8/2002 Sauer ..... B65D 5/4208 206/494
6,648,172 B2 * 11/2003 Leighton ..... B65D 83/0805 221/35
6,672,474 B2 * 1/2004 May ..... A47K 10/421 221/102
6,702,147 B2 * 3/2004 Ashford ..... A47K 10/421 221/34
D501,602 S * 2/2005 Karlsson ..... D3/255
6,863,192 B2 * 3/2005 Tumlinson ..... B65D 5/0005 221/45
D504,314 S * 4/2005 Kim ..... D9/416
D514,437 S * 2/2006 Kim ..... D9/416
7,357,274 B2 * 4/2008 Hewett ..... A47K 10/424 221/34
8,302,810 B2 * 11/2012 Mulhern ..... B60N 3/101 221/34
8,752,729 B2 * 6/2014 Maccario ..... B65D 83/08 221/34
2002/0092789 A1 * 7/2002 Sauer ..... B65D 83/0888 206/494
2003/0178436 A1 * 9/2003 Ashford ..... A47K 10/421 221/33
2007/0045333 A1 * 3/2007 Mitchell ..... B65D 83/0888 221/34
2008/0011766 A1 * 1/2008 Jordan ..... B65D 83/0894 221/45
2013/0228589 A1 * 9/2013 Nickerson ..... A47K 10/46 221/102
2015/0001238 A1 * 1/2015 Franklin ..... A47K 10/421 221/45
2015/0129604 A1 * 5/2015 Gluck ..... B65D 83/0888 221/34
2015/0230574 A1 * 8/2015 Rorie ..... A45C 7/0086 190/111
2016/0101001 A1 * 4/2016 Young ..... A61F 13/5512 221/102
2019/0261765 A1 * 8/2019 Alonzo ..... A45C 3/00

* cited by examiner

TISSUE DISPENSER

TECHNICAL FIELD

Light-weight containers for holding, transporting and dispensing light-weight tissues and other wipes which provide for dispensing unused tissues from one compartment and receiving used tissues into the second compartment.

BACKGROUND OF THE INVENTION

In these times, people move from room-to-room and place-to-place frequently. This invention provides devices for keeping a tissue dispenser with such people as they move from place to place that eliminates the need for searching for a separate waste disposal container by providing an integrated waste disposal compartment.

SUMMARY OF THE INVENTION

Container for holding, transporting and dispensing tissue, wet wipes, makeup remover towelettes and the like, having at least two compartments for dispensing unused tissues from one compartment and receiving used tissues into the second compartment. In a second embodiment, the second compartment is designed to receive and secure bio-waste.

DESCRIPTION OF EMBODIMENTS OF THE INVENTION

Figure 1:
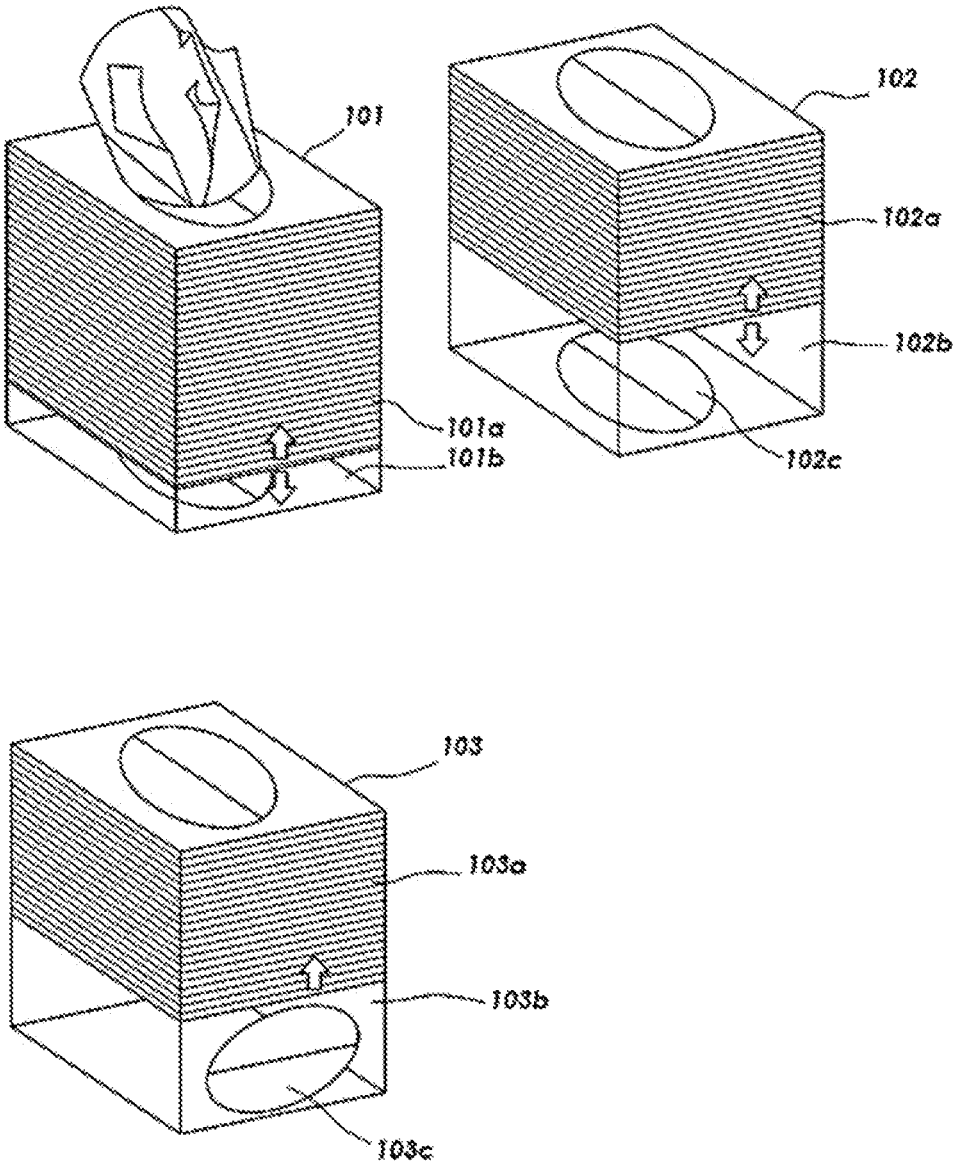
FIG. 1 includes perspective views of the invention showing a plurality of compartments together with perspective views of the invention as whole.

Referring to FIG. 1, one embodiment of invention 100 is shown utilizing a standard tissue box. The view at 101 illustrates distribution and storage of fresh tissues at top compartment 101*a*, and no used tissues in the bottom compartment 101*b*. View 102*a* shows about half of the unused tissues have been dispensed. Compartment 102*b* has received used tissues (not shown) via opening 102*c* at the bottom or side thereof. In similar fashion, bottom compartment 103*b* has received used tissues (not shown) via side opening 103*c*. As can easily be understood, as the volume of used tissues increases as they are used and stored in the bottom compartment of invention 100, it tends to force the used tissue compartment toward the top of the top compartment of the invention.

Figure 2:
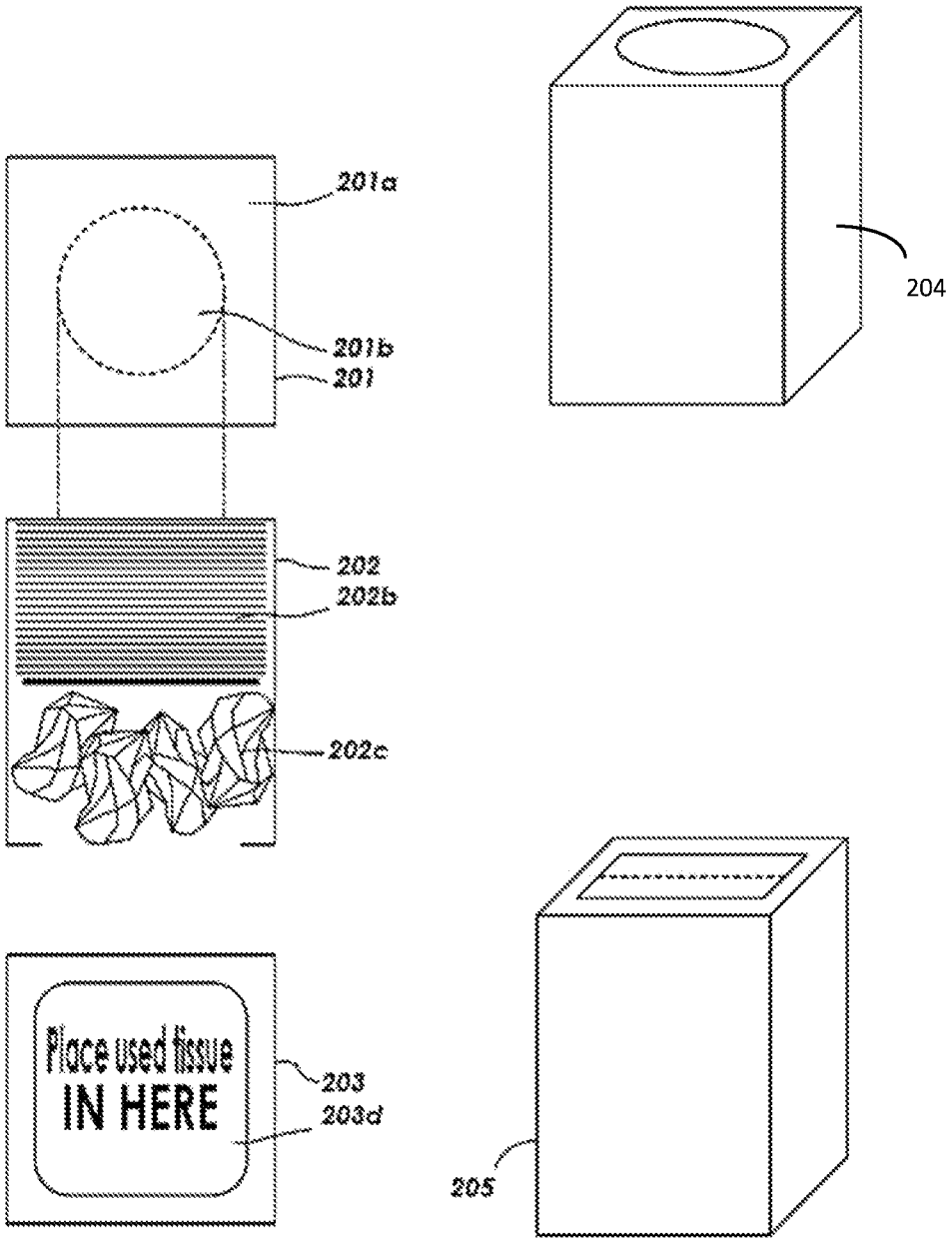
FIG. 2 illustrates the operation of the invention as tissues are removed from one compartment for use and disposed in the second compartment after use.

Referring to FIG. 2, a second embodiment of the present invention utilizes a cube-shaped tissue box in like manner as described in view 101. Here, top compartment 201*a* stores layers of fresh tissues as shown. The tissues are loaded into the top compartment and accessed by a user for use via standard tissue box access port 201*b*. See also view 204. Used tissues are stored in bottom compartment 203 via access port 203*d* located in the bottom of compartment 203.

Again, as the volume of used tissues increases and stored in bottom compartment 203, it tends to force the unused tissues to the top of the box. A slitted 2 mil polyethylene material is included in both of bottom compartments 204 at 204*a* to retain used tissues in bottom compartment 204.

Figure 3:
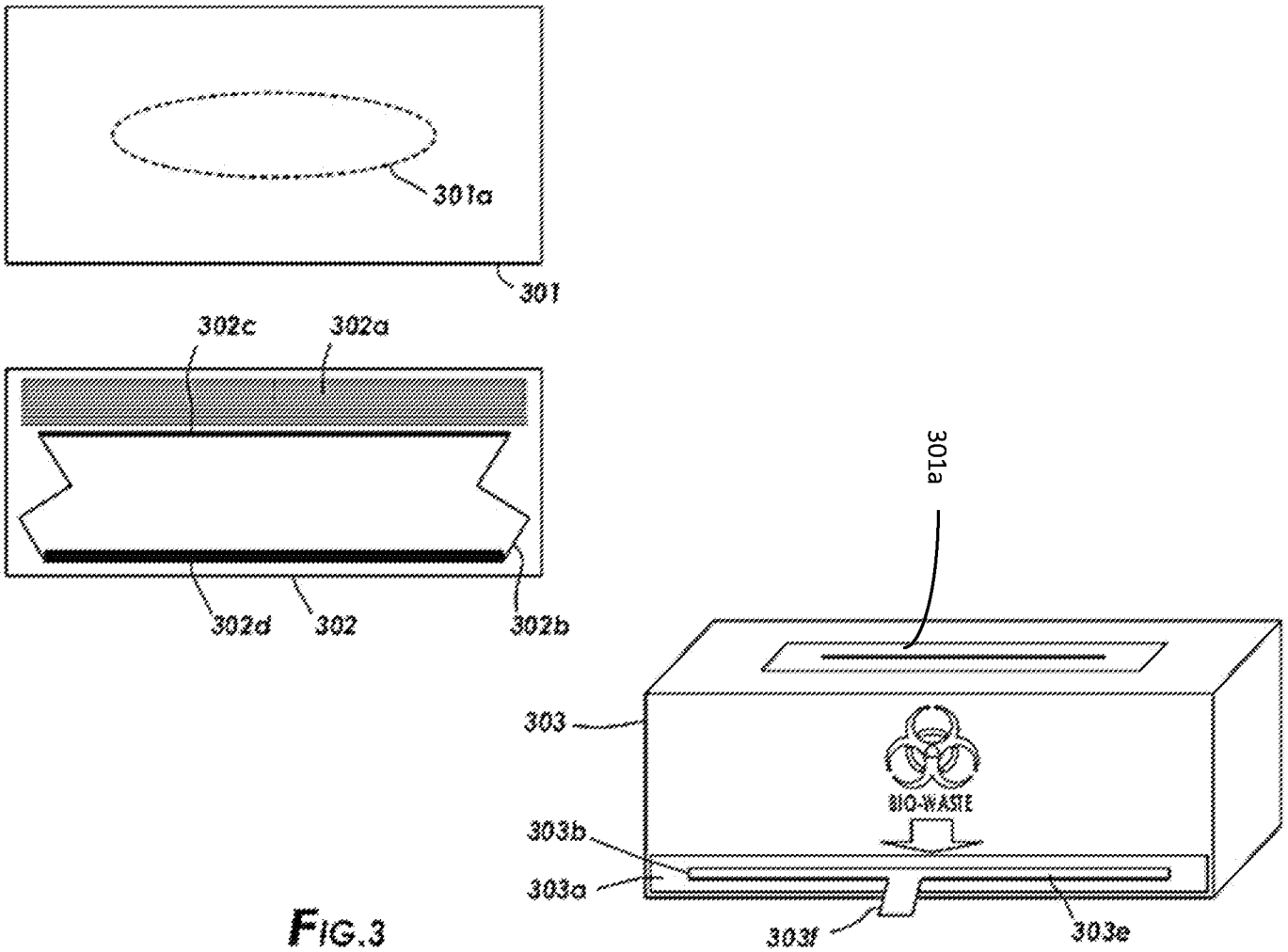
FIG. 3 is the invention of FIG. 1 where the second compartment is a cut-away side view of the lower compartment and is configured for containing the hazards arising from use with bio-waste.

Referring to FIG. 3, a standard size tissue box having a resealable bio-waste Zip-lock™ bag 302*b* is shown at the lower front side of box 303 and a standard tissue opening 301*a* is located at the top 301 of box 303. The bottom of box 303 is disposed at the opposite side of standard tissue opening 301*a*. At 303*a*, box 303 receives and contains tissues used in connection with bio-waste material in a second compartment 303*a*. Bio-waste cavity (second compartment) 303*a* is accessed at 302*d* as shown also at 303*b*. In various embodiments, the length of the second compartment 303*a* is substantially longer than the width of the second compartment 303*a*. A side cut-away view of the second compartment 302 shows a 1 mil polyethylene bag 302*b*. Rectangular cardboard separator 302*c* separates the stored unused top tissues 302*a* from the used tissues stored in the bottom of the bottom compartment 303*a*. It also provides for an even-upward pressure on the unused tissues.

Referring still to FIG. 3, the bottom of polyethylene bag, having first zipper 303*e* is sealed/glued to bottom of box 303, and includes pull tab 303*f* for easy access. Zipper 303*e* may be folded so that it does not protrude beyond the outline configuration of box 303. Zipper 303*e* is also configured to span substantially the entire length of the second compartment 303*a*.

Figure 4:
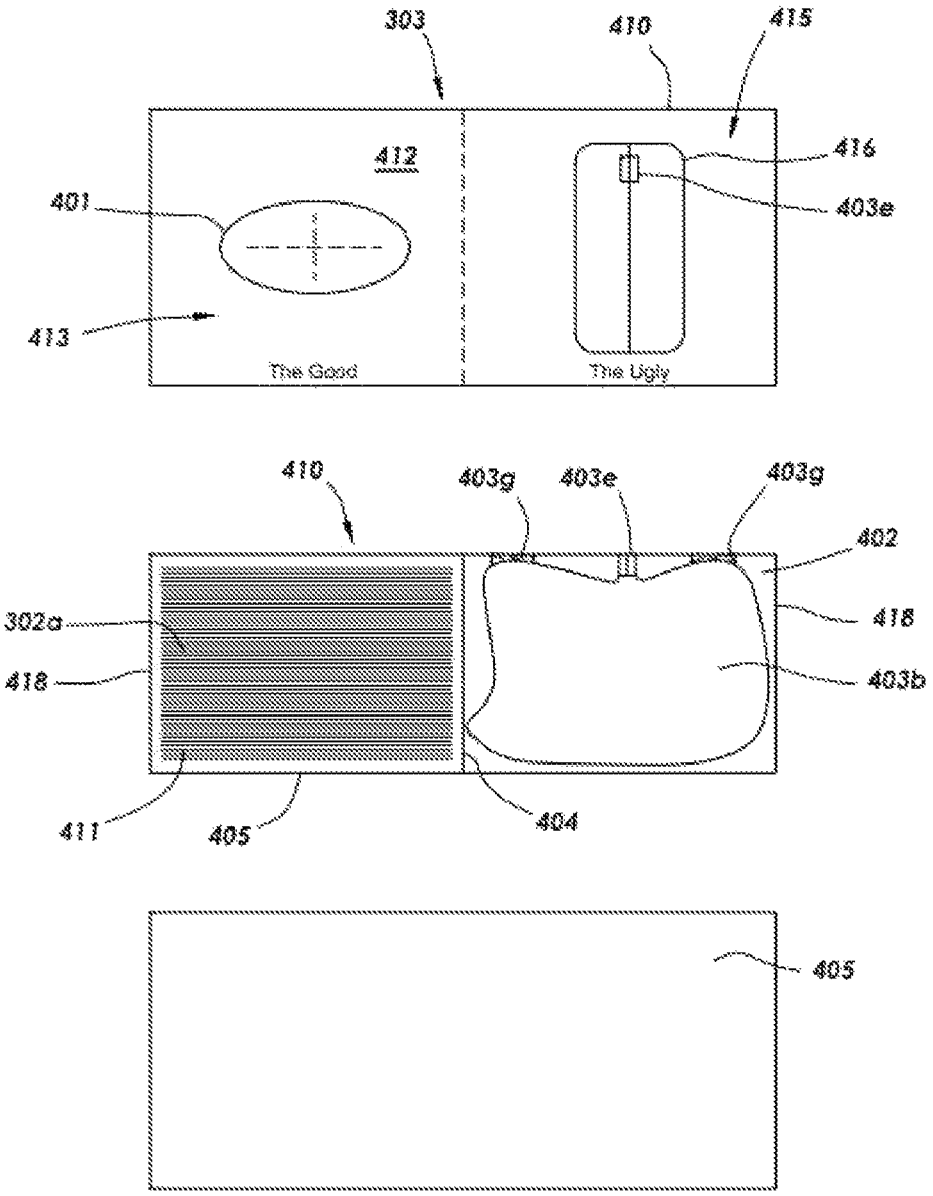
FIG. 4 includes a top view, a cut-away side view, and a bottom view of one embodiment of the invention.

Referring to FIG. 4, a standard tissue box 303 is shown that includes a standard tissue box opening 401 disposed at the top of box 303 for access to tissue 302*a* stored in a first compartment 411. In an embodiment, tissue 302*a* (e.g., unused tissues) may be dispensed from the first compartment 411 via the standard tissue box opening 401. In the embodiment of FIG. 4, tissue box 303 includes a rigid housing 410 comprising a plurality of rigid faces, including at least a rectangular top face 412 having a length and a width, a rectangular bottom face 405, and a plurality of parallel vertical faces 418, each coupling the top face 412 to the bottom face 405. In an embodiment the bottom face 405 is at least substantially flat. The top face 412 comprises a first portion 413 including the standard tissue box opening 401. The first compartment 411 is within the rigid housing 410 and is formed at least in part by the first portion 413 of the top face 412 including the tissue box opening 401. In the embodiment of FIG. 4, the tissue box opening 401 comprises an ellipsis having a major axis oriented at least substantially parallel to the length of the top face. For example, tissue box opening 401 may be parallel to the length of the top face. Top face 412 further comprises a second portion 415 including a bio-waste opening 416 providing accessibility to a second compartment ("bio-waste cavity") 402. The second compartment is formed at least in part by the second portion 415 of top face 412 including the bio-waste opening 416, and includes a bottom formed at least in part by the bottom face 405. A user may place used tissue (e.g., after a user has sneezed into one of tissues 302*a*) through bio-waste opening 416 into bio-waste cavity 402. The bottom face 405 of box 303 is disposed at the opposite side of top face 412 and tissue box opening 401. In embodiments, the bio-waste opening 416 may be rectangular. The bio-waste opening 416 may be oriented perpendicular to the standard tissue box opening 401. For example, bio-waste opening 416 may be oriented perpendicular to the major axis of standard tissue box opening 401. The standard tissue box opening 401 and first compartment 411 are disposed next to or adjacent to the bio-waste cavity 402 accessible through bio-waste opening 416. The bio-waste cavity 402 (second compartment) includes a polyethylene bag 403*b*, having a zipper 403*e* for receiving used tissue. In an embodiment, when the zipper 403*e* is unzipped, the polyethylene bag 403*b* and zipper 403*e* fill or open into at least substantially all of the bio-waste opening 416. In an embodiment, a user must unzip zipper 403*e* to place used tissue in polyethylene bag 403*b*, and will not accidentally place used tissue in bio-waste cavity 402. In an embodiment the zipper 403*e* of polyethylene bag 403*b* is oriented at least substantially parallel to a length of bio-waste opening 416, and is at least substantially perpendicular to the major axis of standard tissue box opening 401 so that when zipper 403*e* is unzipped, used tissue products placed through bio-waste opening 416 will pass into polyethylene bag 403*b*. In one embodiment, the shape of the bio-waste cavity is rectangular to avoid confusion with the elliptical shape of the standard tissue box opening 401. In various embodiments, zipper 403*e* spans substantially the entire length of bio-waste opening 416. Referring still to FIG. 4, a rectangular cardboard separator 404 separates the stored unused tissue 302*a* from the used tissue stored in the polyethylene bag 403*b*. In various embodiments, the top of the polyethylene bag 303*e* is sealed/glued 403*g* to the top of box 303. In an embodiment, polythethylene bag 403*b* includes a surface edge which includes zipper 403*e*, and the surface edge is at least substantially flush with the bio-waste opening 416 when unzipped.

INDUSTRIAL APPLICABILITY

Suitable for any application requiring storing, transporting and dispensing any flexible material requiring separation while stored, transported and dispensed.

What is claimed is:

1. A container for holding, transporting, and dispensing tissue products, comprising:

a rigid housing, the rigid housing including:

a plurality of rigid faces, the plurality of rigid faces including at least a rectangular top face having a length and a width, a flat rectangular bottom face, and a plurality of parallel vertical faces each coupling the top face to the flat bottom face, wherein the top face comprises:

a first portion comprising an elliptical first opening having a major axis oriented parallel to the length of the top face; and a second portion comprising a rectangular second opening oriented perpendicular to the first opening, the second opening having a length perpendicular to the major axis of the elliptical first opening;

a first compartment within the housing formed at least in part by the portion of the top face including the first opening, wherein the first compartment is for storing one or more unused tissue products, wherein the first compartment is further for dispensing the one or more unused tissue products from the first opening;

a second compartment formed at least in part by the portion of the top face including the second opening, the second compartment further having a bottom formed at least in part by the flat bottom face of the housing, the second compartment for receiving used tissue products placed into the second opening;

a polyethylene bag sealed to the top of the second compartment, the polyethylene bag including a zipper oriented at least substantially perpendicular to the major axis of the first opening, wherein the polyethylene bag is positioned in the second compartment, wherein when the zipper of the polyethylene bag is unzipped, used tissue products placed through the second opening will pass into the polyethylene bag;

a cardboard separator oriented parallel to the vertical faces for separating the one or more unused tissues from the used tissues, and wherein the polyethylene bag includes a surface edge including the zipper, and the surface edge is flush with the top face when the zipper is unzipped.

2. The container of claim 1, wherein the polyethylene bag is a resealable bio-waste bag and the zipper of the polyethylene bag is for sealing and unsealing the polyethylene bag.

3. The container of claim 2, wherein the zipper of the polyethylene bag has a length spanning a length of the second compartment.

4. The container of claim 3, wherein the second compartment is disposed horizontal to the first compartment, and wherein the cardboard separator is configured to provide a vertical sidewall separating the first compartment from the second compartment, and wherein the first compartment and the second compartment are oriented parallel to the orientation of the first opening.

5. The container of claim 3, wherein the first compartment and the second compartment are only respectively accessible through the first opening and the second opening of the container.

6. The container of claim 3, wherein the second compartment is disposed at a substantially similar level to the first compartment.

7. The container of claim 6, wherein a length of the second compartment is substantially longer than a width of the second compartment.

8. The container of claim 1, wherein the polyethylene bag is configured to expand as tissue products are placed into the polyethylene bag, and wherein the cardboard separator is configured to move as the polyethylene bag expands.

9. The container of claim 1, wherein the polyethylene bag is positioned in the second compartment, and wherein, when the zipper of the polyethylene bag is unzipped, the polyethylene bag and the zipper of the polyethylene bag open into at least substantially all of the second opening.

10. The container of claim 1 wherein said compartments are oriented in side-by-side configuration.

* * * * *